United States Patent [19]

Spengler et al.

[11] 4,274,803

[45] Jun. 23, 1981

[54] HIGH-PRESSURE CENTRIFUGAL PUMP UNIT

[75] Inventors: Hans Spengler; Klaus Stoof, both of Halle, German Democratic Rep.

[73] Assignee: VEB Kombinat Pumpen und Verdichter, Halle, German Democratic Rep.

[21] Appl. No.: 37,022

[22] Filed: May 8, 1979

[30] Foreign Application Priority Data

May 29, 1978 [DD] German Democratic Rep. .... 205616

[51] Int. Cl.[3] ..... F04D 17/08

[52] U.S. Cl. ..... 415/70

[58] Field of Search ..... 415/70, 121 R

[56] References Cited

U.S. PATENT DOCUMENTS 2,862,451 12/1958 Holstein ..... 415/70

3,791,760 2/1974 Lipe ..... 415/121 R

FOREIGN PATENT DOCUMENTS 157941 4/1922 United Kingdom ..... 415/70

*Primary Examiner*—Billy J. Wilhite

*Attorney, Agent, or Firm*—Michael J. Striker

[57] ABSTRACT

A high feed centrifugal pump has a housing, a low-speed suction stage arranged in the housing and having an axis, at least one high-speed high pressure stage also arranged in the housing and axially displaced from the low speed suction stage, so that the housing has a suction side and a pressure side, and a drive operative for driving the stages independently of each other and including a first prime mover operative for driving the low speed-suction stage and a second prime mover operative for driving the high-speed high-pressure stage. One of the prime movers which is operative for driving a respective one of the stages is flanged to the housing at a respective one of the sides, whereas the other of the prime movers is flanged to the one prime mover in tandem arrangement.

10 Claims, 4 Drawing Figures

HIGH-PRESSURE CENTRIFUGAL PUMP UNIT

BACKGROUND OF THE INVENTION

The invention concerns a one-stage or multi-stage high-pressure centrifugal pump unit of the vertical or horizontal type, for the delivery of liquids to higher delivery heads.

The pumps of centrifugal pump units for the delivery of liquids to higher delivery heads are in the great majority designed as multi-stage centrifugal pumps with up to fifteen stages. The electrical prime mover mainly used is a three-phase asynchronous motor with the upper limit speeds of $n_{syn}=3000\ min^{-1}$ at 50 Hz, European grid and $n_{syn}=3000\ min^{-1}$ at 60 Hz, North American grid, being determined by the grid frequency. It is also customary to arrange a transmission between the electrical prime mover and a multi-stage centrifugal pump, in order to increase the speed and to reach a pump drive speed higher than $n=3000\ min^{-1}$. (Technisches Handbuch Pumpen, VEB Verlag Technik Berlin, 5. Auflage 1976; Kleines Pumpenhandbuch für Chemie und Technik, Verlag Chemie GmbH, Weinheim 1967). Other prime movers, such as internal combustion engines and turbines are also being used.

The disadvantage of these pump units lies primarily in the fact that with the design size as applied to the customary design of pump units, it is not possible to attain a greater delivery head concurrently with maintaining a good degree of efficiency, good suction, and reliable operation at a manufacturing expense that can be economically justified. The manufacturing expenditure will be too high relative to the time required for manufacture, the expenditure for materials and the dimensions.

The known multi-stage types of pumping unit of conventional design, representing the present state of the art thus are no solutions with optimal economics. Added to this, the operating characteristics, especially vibration and wear characteristics, are not satisfactory. There have been recent endeavors to eliminate the acceptance of disadvantages in the design of pumping units with multi-stage centrifugal pumps, by using high-speed single-stage centrifugal pumps. Proceeding from the fact that with a given output the impeller diameter becomes smaller with increased drive speeds, the entire pump unit will become more compact, more economical in manufacturing, procurement, installation, and also operation with higher intended drive speeds, with a concomitant improvement of the operating characteristics. These deliberations have lead to the development of a known high-speed, one-stage or two-stage transmission-driven pump for outputs of V up to 160 $m^3/h$ and H up to 1700 m.

The disadvantages of a relatively poor suction are reduced herein by an inducer arranged prior to the high-pressure stage. The pump has electric drive by a three-phase asynchronous motor. The suction stage (inducer) and the high-pressure stage are on a common shaft and rotate at the same speed. The transmission, arranged vertically between the centrifugal pump and the drive motor, will increase the motor speed of $N=3000\ min^{-1}$ to output speeds of the magnitudes of about $N=40{,}000\ min^{-1}$. Instruments to monitor the operating conditions are arranged within the transmission. A metering oil pump maintains a continual circulation of lubricating oil within the transmission. The lubricating oil is regenerated by filters and heat exchangers (Kleines Pumpen Handbuch für Chemie und Technik Verlag Chemie GmbH, Weinheim 1967). An improvement in the construction of the transmission has led to elimination of the oil pump and the heat exchanger, the high speed up to $n=40{,}000\ min^{-1}$ notwithstanding (German Letter of Disclosure No. 22 13 731). The demand for a modification of the delivered flow of a centrifugal pump unit already installed in an industrial plant is met, within defined limits, in the first line by applying the uneconomical throttle regulation.

Infinitely variable speed regulation, with low losses in considerably more economical than throttle regulation. With multi-stage or single-stage centrifugal pump units, economical infinitely variable flow regulation is, f.i., not readily possible with the known electric prime movers. All mechanical and electrical devices known hitherto for infinitely-variable speed regulation, such as f.i. fluid couplings, variable-speed transmissions, high-frequency motors with frequency converter, direct-current motors with mercury-vapor rectifier, et al, are economically expensive solutions.

SUMMARY OF THE INVENTION

It is the objective of the invention, to create a high-pressure centrifugal pump unit which is of greater advantage in technology and economics when compared to the known designs.

The invention is based upon the task of developing a high-pressure centrifugal pump unit distinguished by a greater delivery head with concomitant attainment of such a degree of efficiency as can be justified economically, by very good suction characteristics of the first stage, and by a low-loss flow regulation, as well as by maintaining minimal dimensions and mass.

As per invention, this task is solved by providing within a single or multi-part pump housing a low-speed suction impeller and, arranged axially after it, one or several high-speed high-pressure stages with the drive of the suction stage and of one or several high-pressure stages, being independent of each other and at constant or variable speed.

Another feature of the invention is the fact that the drive of the low speed suction stage is via a hollow shaft, by a known low-speed prime mover with or without variable speed, flanged onto the suction side of the pump housing, and that the drive of one or several high-speed high-pressure stages is via a solid shaft running within the hollow shaft, by a known high-speed prime mover with, or without variable speed, flanged, in tandem arrangement, onto the prime mover of the suction stage.

In a further version of the invention the drive of one or several high-speed high-pressure stages is effected, via a hollow shaft, by a known high-speed prime mover, with, or without, variable speed, flanged onto the pressure side of the pump housing, and the drive of the low-speed suction stage is effected, via a solid shaft running through the hollow shaft, by a known low-speed prime mover with, or without, variable speed which is flanged in tandem arrangement onto the prime mover of the high-pressure stage.

A further feature is that the drive of the low-speed suction stage is effected, via a shaft, by a known low-speed prime mover with, or without variable speed, flanged onto the suction side of the pump housing, and that the drive of one or several high-pressure stages is, via a shaft, by a known high-speed prime mover, with, or without variable speed, flanged onto the pressure side of the pump housing. It is also a feature of the invention that the drive of the low-speed suction stage can be effected via a shaft, by a known low-speed prime mover with or without variable speed, flanged onto the suction side of the pump housing, and the drive of the high-speed high-pressure stage, which may consist of one or several stages, also being effected by a known low-speed prime mover, with or without speed regulation, via a transmission which is in fixed attachment to the pressure side of the pump housing and the prime mover. Furthermore, the invention is featured by the prime movers being known direct-current motors supplied from the two-phase or three-phase grid via diodes or thyristor acting as rectifiers, or frequency-controlled three-phase motors, internal combustion engines, or turbines.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
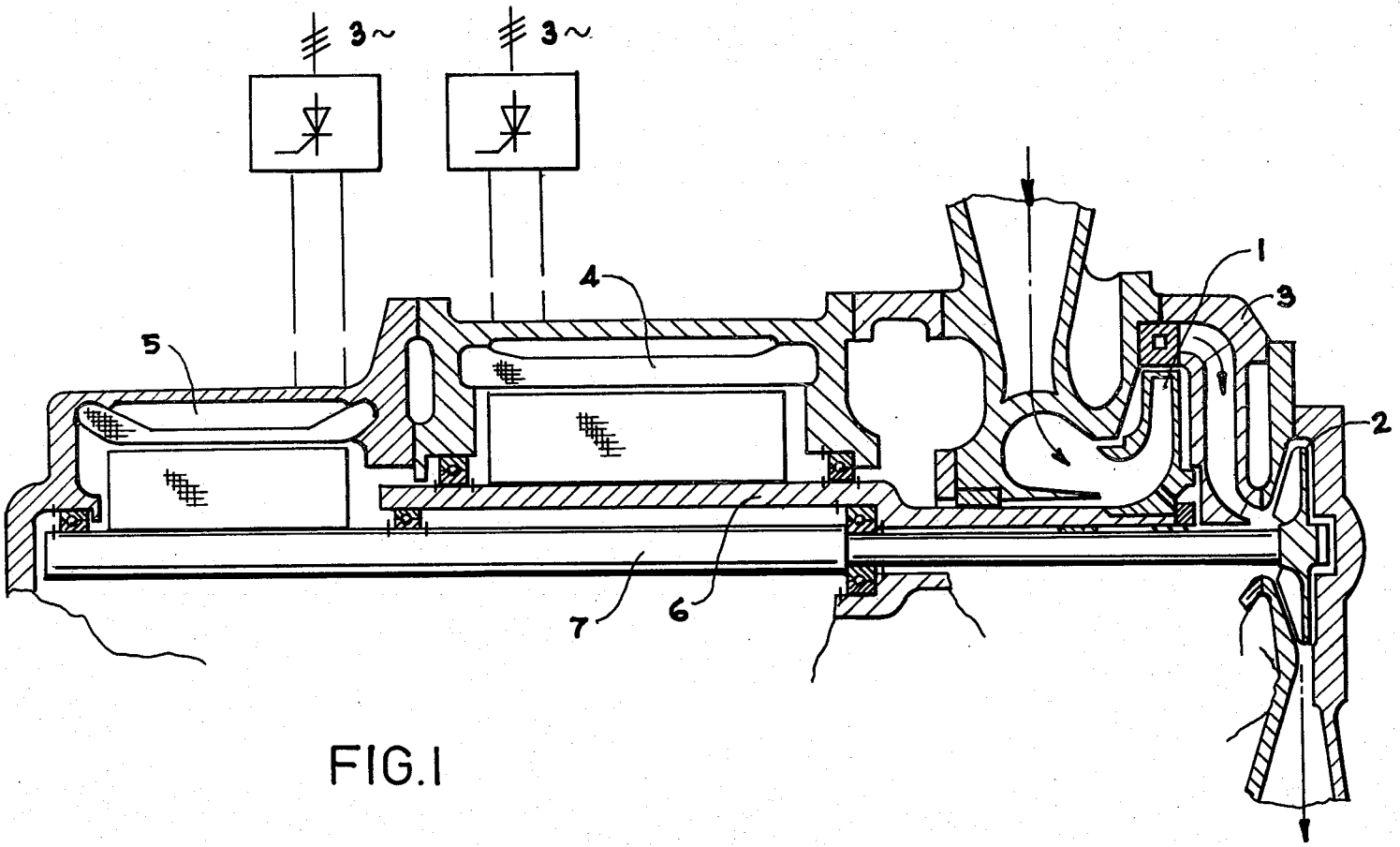
FIG. 1: A two-stage high-pressure centrifugal pump unit with prime movers in tandem arrangement

According to an embodiment of the invention as shown in FIG. 1 a unit is provided where a one-part or multi-part pump housing 3 contains a suction stage 1 and a high-pressure stage 2. Flanged onto the suction side of the pump housing 3, is a low-speed direct-current motor 4, with or without variable speed, which is supplied from the grid with alternating or direct current, via a diode or thyristor acting as rectifier.

The motor 4 drives the suction stage 1 via the hollow shaft 6. Flanged in tandem arrangement onto the motor 4, is a high-speed direct-current motor 5 with, or without, variable speed, supplied from the grid with alternating or direct current, via a diode or thyristor acting as rectifier, and which drives the high-pressure stage 2 via the solid shaft 7 which runs through the hollow shaft 6.

Figure 2:
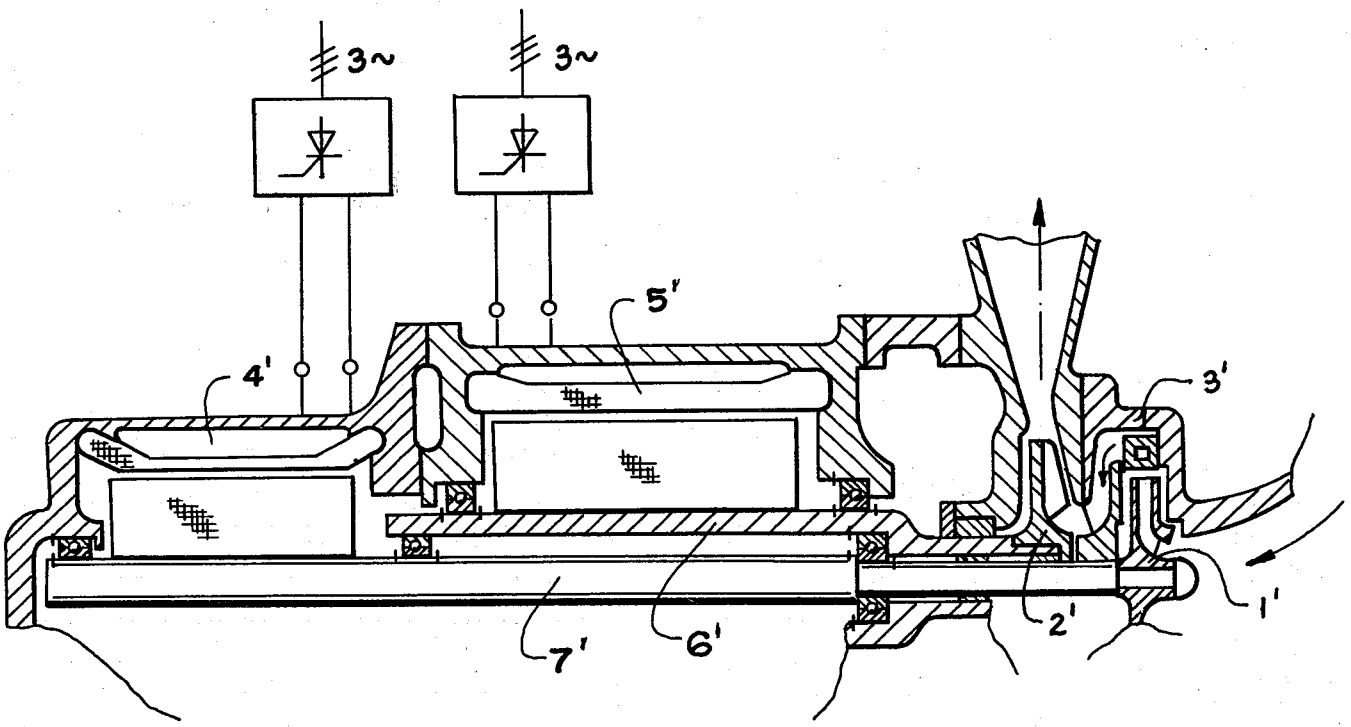
FIG. 2: A two-stage high-pressure centrifugal pump unit with prime movers in tandem arrangement but with pump stages being in reverse arrangement of FIG. 1

FIG. 2 shows an embodiment of the invention where a known high-speed, direct-current motor 5', with, or without, variable speed, supplied from the grid with alternating or direct-current, via a diode or thyristor acting as rectifier, is flanged onto the pressure side of the pump housing 3', driving, via the hollow shaft 6' the high-pressure side 2'. Flanged in tandem arrangement onto the motor 5', is a known low-speed direct-current motor 4', which is supplied from the grid with alternating or direct-current, via a diode or thyristor acting as rectifier, driving the suction stage 1' via a solid shaft 7' which runs through the hollow shaft 6'.

Figure 3:
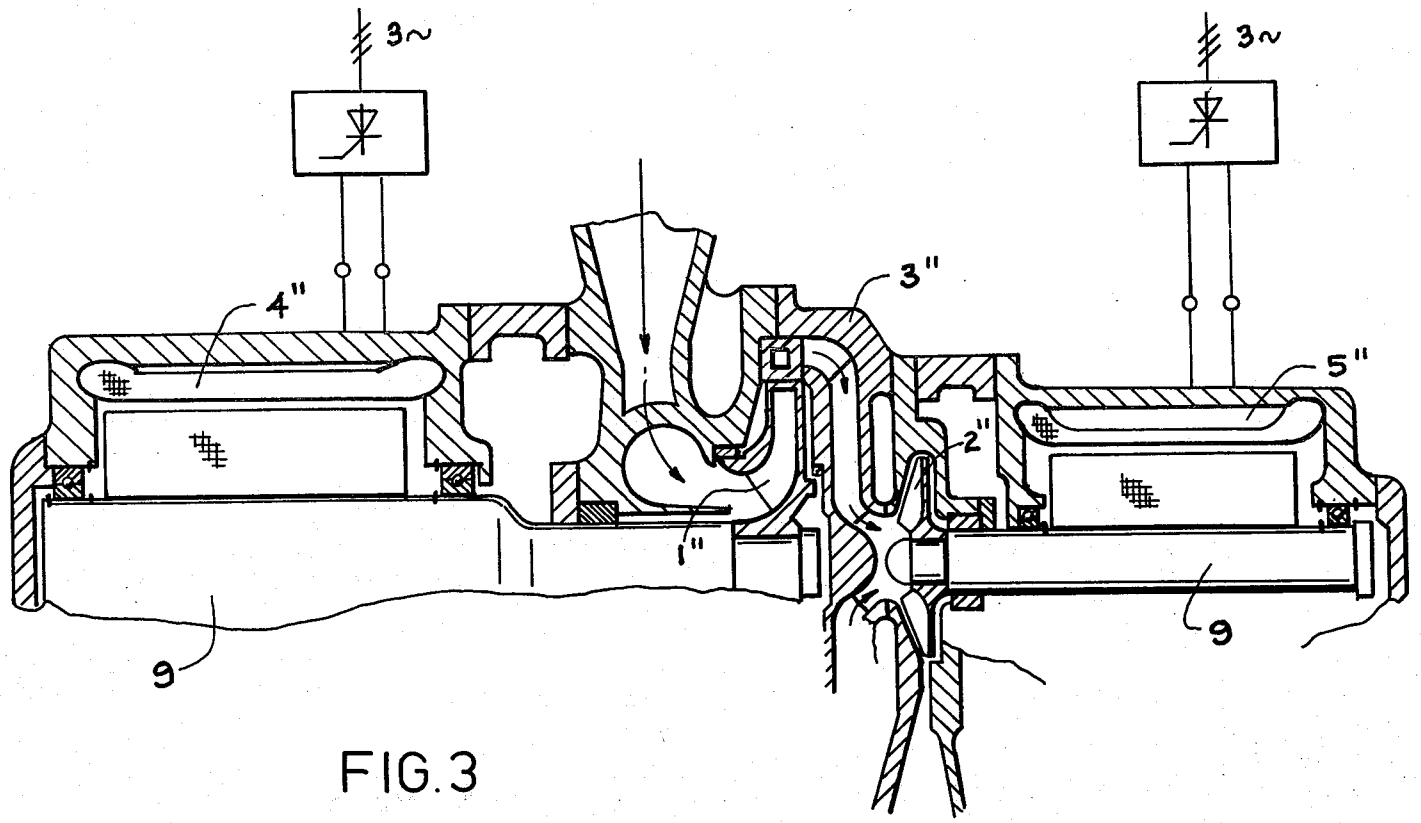
FIG. 3: A two-stage high-pressure centrifugal pump unit, with prime movers being arranged on each side of the pump housing.
Figure 4:
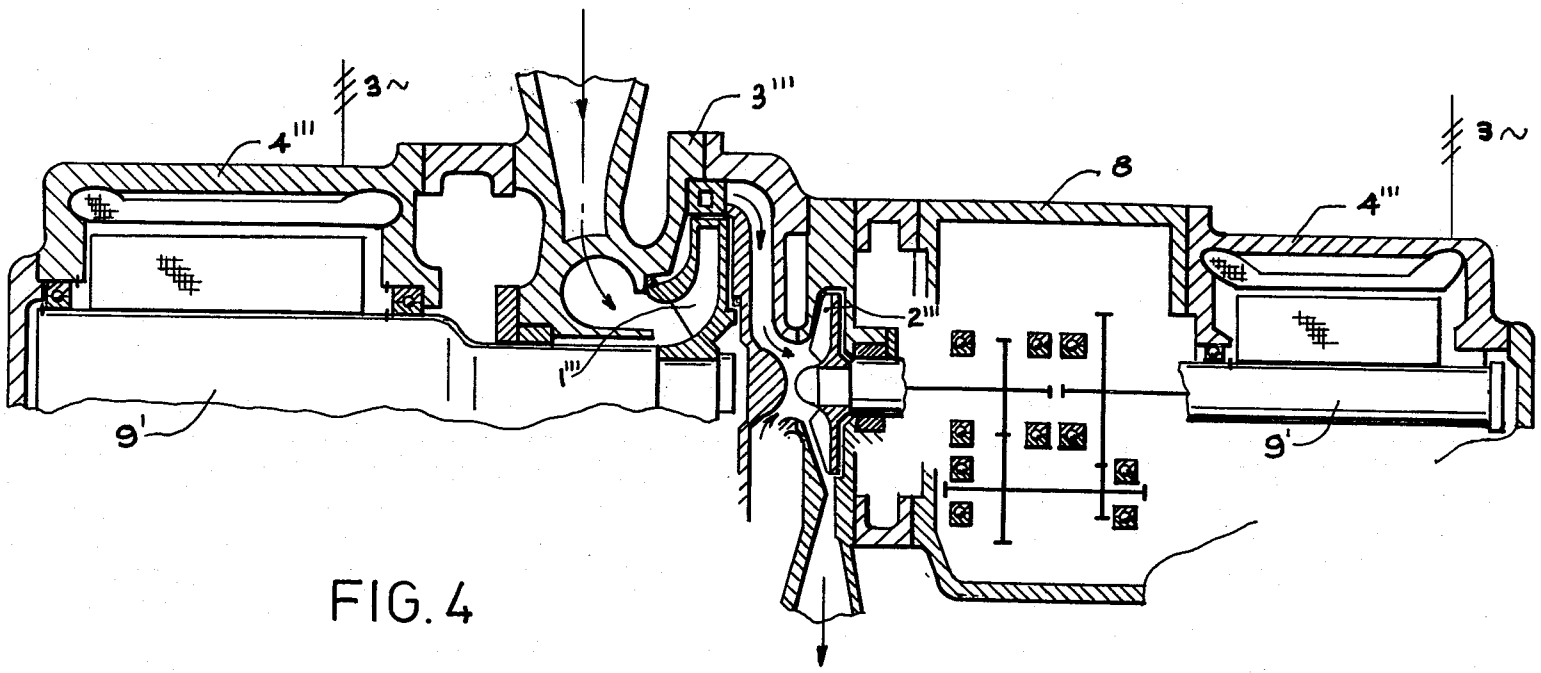
FIG. 4: A two-stage high-pressure centrifugal pump unit, with prime movers being arranged, as per FIG. 3, however with an interposed transmission for the drive of the high-pressure stage.

FIG. 3 shows an embodiment of the invention where the pump housing 3'' contains a suction stage 1'' and a high-speed stage 2''. Each stage is driven, independent of each other, via the shaft 9 by a known high-speed or low-speed respectively direct-current motor 4'', 5'' with or without, variable speed, supplied from the grid with alternating or direct-current, via a diode or thyristor acting as rectifier. In the embodiment as per FIG. 4, a two-stage unit has been designed, containing within a one-part or multi-part pump housing 3''' a suction stage 1''' and a high-speed stage 2'''.

The suction stage 1''' is directly driven via the shaft 9', by a known low-speed three-phase asynchronous motor, with, or without, variable speed, which is flanged onto the suction side of the pump housing 3'''. Independent of the suction stage 1''', a high-speed stage 2''' is driven by a three-phase asynchronous motor, also a low-speed unit. A transmission 8 is in firm attachment between motor 4''' and the pressure side of pump housing 3'''. The advantages of the invention lie in the fact that a single-stage or multi-stage centrifugal pump of small dimensions and mass, with a low-speed suction stage and one or several high-speed high-pressure stages, is combined in tandem into a compact unit, the stages being driven, simultaneously but independent of each other, at constant or infinitely variable speed, each by a low-speed or high-speed prime mover respectively.

By the small number of components and parts, an economical production, economic utilization of materials, and economical operation are achieved. By the independence in respect of their speeds, of the suction stage and the high-pressure stage, a high delivery head and an economically justifiable degree of efficiency are ensured concomitant with good suction characteristics.

It will be understood that each of the elements described above, or two or more together, may also find a useful application in other types of constructions differing from the types described above.

While the invention has been illustrated and described as embodied in a multi-stage high-pressure centrifugal pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A high-speed centrifugal pump, comprising a housing; a low-speed suction stage arranged in said housing and having an axis; at least one high-speed high-pressure stage also arranged in said housing and axially spaced from said low-speed suction stage, so that said housing has a suction side and a pressure side; and drive means operative for driving said stages independently of each other and including a first prime mover operative for driving said low-speed suction stage and a second prime mover operative for driving said high-speed high-pressure stage, one of said prime movers which is operative for driving a respective one of said stages being flanged to said housing at a respective one of said sides, the other of said prime movers being flanged to said one prime mover in tandem arrangement.

2. A pump as defined in claim 1, wherein said housing is a one-piece member.

3. A pump as defined in claim 1, wherein said housing is composed of a plurality of parts.

4. A pump as defined in claim 1; and further comprising a plurality of such high-speed high-pressure stages.

5. A pump as defined in claim 1, wherein said drive means is operative for driving said stages at a constant speed.

6. A pump as defined in claim 1, wherein said drive means is operative for driving said stages at a variable speed.

7. A pump as defined in claim 1, wherein said first prime mover which is operative for driving said low-speed suction stage is flanged to said suction side of said housing, said second prime mover which is operative for driving said high-speed high-pressure stage being flanged to said first prime mover.

8. A pump as defined in claim 7, wherein said first prime mover is a low-speed prime mover having a hollow shaft, said second prime mover being a high-speed prime mover having a solid shaft which extends through said hollow shaft.

9. A pump as defined in claim 1, wherein said second prime mover which is operative for driving said secong high-speed high-pressure stage is flanged to said pressure side of said housing, said first prime mover which is operative for driving said suction stage being flanged to said second prime mover.

10. A pump as defined in claim 9, wherein said second prime mover is a high-speed prime mover having a hollow shaft, said first prime mover being a low-speed prime mover having a solid shaft extending through said hollow shaft.

* * * * *